United States Patent [19]

Hesterberg

[11] Patent Number: 4,557,101

[45] Date of Patent: Dec. 10, 1985

[54] METHOD AND APPARATUS FOR ATTACHING A TOKEN TO A CONTAINER

[75] Inventor: Eugen Hesterberg, Berlin, Fed. Rep. of Germany

[73] Assignee: B.A.T. Cigaretten-Fabriken GmbH, Fed. Rep. of Germany

[21] Appl. No.: 467,398

[22] Filed: Feb. 17, 1983

[30] Foreign Application Priority Data

Feb. 18, 1982 [DE] Fed. Rep. of Germany ..... 3206077

[51] Int. Cl.[4] ..... B65B 61/00; B65C 9/08

[52] U.S. Cl. ..... 53/50; 53/137; 493/120; 493/375; 493/911

[58] Field of Search ..... 53/50, 254, 137, 130; 493/84, 120, 375, 379, 911, 910, 961

[56] References Cited

U.S. PATENT DOCUMENTS

| | | | |
|---|---|---|---|
| 2,487,303 | 11/1949 | Brahe et al. | 53/50 |
| 2,935,827 | 5/1960 | Burt | 53/50 X |
| 3,531,354 | 9/1970 | Hetzinger et al. | 53/50 X |
| 4,086,744 | 5/1978 | Seragnoli | 53/137 |
| 4,173,173 | 11/1979 | Mims | 493/137 |

*Primary Examiner*—James F. Coan

*Attorney, Agent, or Firm*—Roylance, Abrams, Berdo & Goodman

[57] ABSTRACT

A token, such as a coin for making change in a cigarette package dispensing machine, is inserted into a "hard pack" or box of the type having a hinged lid by placing the token on the front face of the box, pressing down on the front face to form a slit-like opening under the edge of the lid, and then shoving the token under the lid through the opening. One or more recesses can be formed in a box insert under the lid to accept the token or tokens. An apparatus for accomplishing this is disclosed.

16 Claims, 3 Drawing Figures

METHOD AND APPARATUS FOR ATTACHING A TOKEN TO A CONTAINER

BACKGROUND OF THE INVENTION

It is known to attach coins or other small objects to packages of goods, especially to cigarette packs. Devices for accomplishing this are commonly found in the conveyor path of a packaging machine wherein coins or the like can be delivered to the side of a pack and can be held there until the coins are finally secured tightly to the pack with a sheathing of paper or film which forms the conventional package cover.

This type of coin attachment, in which the packs are prepared for sale by dispensing in automatic dispensing machines, are arranged such that the coins lie between the long side of the parallelepipedic package and the film wrapping around the pack, and the same technique has been used for both soft and hard packs. The hard packs, referred to as boxes, hard packs or hinge-lid packs, are generally formed of a rather stiff material such as cardboard and include a hinged cover forming the top of the pack. The cover is hinged along a fold line extending transversely across the back of the pack, the front and side flaps in the closed position terminate at lower edges which lie in a separation plane which runs obliquely forward, preferably downwardly from the hinge line, the abutment edges thereof limiting the pack opening. In addition, inside of the lid, there is normally an insert which projects from the pack opening and includes at least one portion lying immediately behind the front flop of the lid when it is closed.

With such hard packs, and because of the high work speeds with machine packaging, coins attached to the packs can easily damage the foil wrap around the pack. Thus, not only is the freshness of the product contained therein adversely affected when the wrap is damaged, but in addition the appearance of the finished pack and the security of attachment of the coins or the like is adversely affected.

BRIEF DESCRIPTION OF THE INVENTION

Accordingly, an object of the present invention is to provide an improved method by which coin-like tokens can be satisfactorily and economically attached to a relatively stiff container, even with automatic machinery and at the high work speeds employed in packaging machinery, particularly in the cigarette industry.

Additionally, an object is to provide a method for attaching such tokens which permits attachment of coins of larger diameters than previously possible.

Additionally, it is an object to provide an apparatus capable of automatically performing the attachment process.

Briefly described, the invention includes a method for attachment of a coin-like token to a generally parallelepipedic container, such as a cigarette box, of the type formed from stiff material and having a hinged cover with a front flap which forms a transverse abutment line with the front face of the container in its closed position, including securely holding the container with its front face up and the cover closed, placing a token on the front face of the container adjacent the abutment line, pressing downwardly on the front face of the container to form a slit-like opening between the front face and the lower edge of the cover flap, pushing the token under the flap through the opening, and releasing the downward pressure.

Additionally, the invention comprises an apparatus for attaching a coin-like token to a generally parallelepipedic container, such as a cigarette box, of the type formed from stiff material and having a hinged cover with a front flap which forms a transverse abutment line with the front face of the container in its closed position, comprising conveyor means for delivering a container to a predetermined location at an attachment station, stop means for holding a container at said location, a feed chute near said attachment station for delivering tokens to the end thereof, a pivotally mounted delivery arm having means defining a recess at one end for holding a token, said arm being swingable between a receiving position in which said recess is adjacent the end of said chute for receiving a token and a delivery position in which said recess is pressing against the front face of a container in said predetermined location, thereby forming an opening between said front face and the cover flap, means for blocking the end of said chute when said delivery arm is not in said receiving position, and a pusher arm movable into said recess to push a token therefrom into said opening and under said cover flap.

As will be recognized from the following detailed description, the technique according to the invention permits the attachment of coins or similar tokens under the cover flap of hard packs such that the attachment finds customer acceptance and is secure. Since coins are not visible from the outside, the appearance of the pack is not adversely influenced. Further, there is no danger of damage to the film wrap around the pack and the attachment process, with the subsequent wrapping of the pack, in accordance with the invention occur completely independently of each other. Thus, the invention avoids difficulties and problems which arise in the present state of the art wherein it must somehow be guaranteed that the coins which are inserted along the side of a narrow pack are prevented from falling away from that position under the normal handling conditions, thus damaging the film wrap placed around the package. Because of this, more complex technical solutions and the financial expenditure associated therewith are avoided with this invention.

As suggested previously, one advantage of the invention lies in the possibility of inserting coins under the hinged cover in such a way that coins which are larger than those previously usable can be attached. For example, a coin the size of a one deutschmark coin, or a twenty-five cent coin in the United States, could not previously be attached along the narrow side of the package because of the physical limitation in the thickness of the package along that side.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF THE INVENTION

Figure 1:
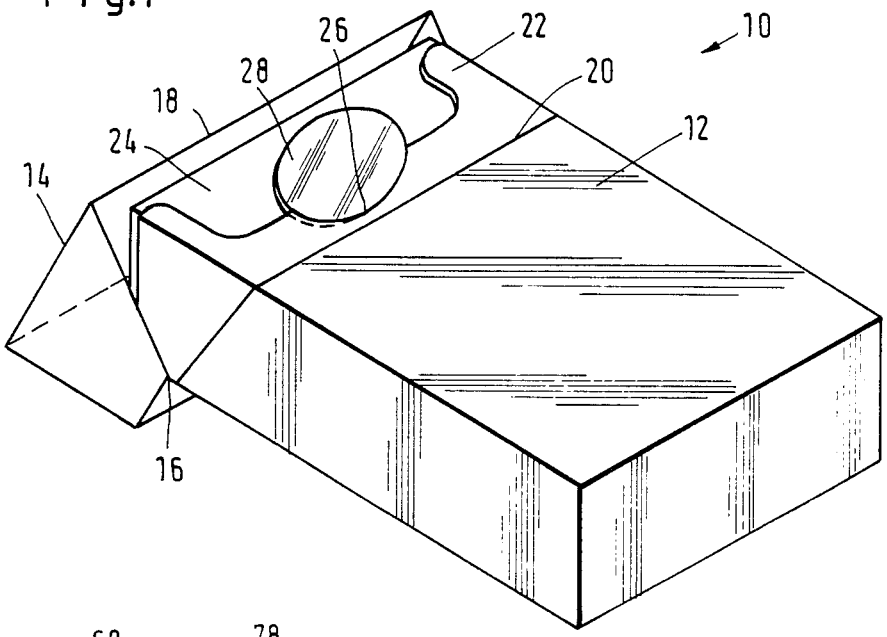
FIG. 1 is a perspective view of a typical cigarette hard pack with a hinged cover, shown partly in its open position, and with an attached token in accordance with the invention.

Referring first to FIG. 1, it will be recognized that the figure illustrates a hard pack for cigarettes indicated generally at 10 which comprises a container of parallel-epipedic shape, used for cigarettes, having a housing portion 12 and a cover 14 forming the top of the pack, the cover being attached to the housing section along a fold line 16 which extends transversely across the back of the package, forming a hinge line to permit repeated opening and closing of the container.

The edges of the front and side flaps, which are connected to each other as part of the generally rectangular cover 14 are in abutting or edge-to-edge contact with the edge of the pack opening.

The closure edge 18 of the front flap of cover 14 is thus drawn down visor-like thus abuts the opening edge 20 on the front of the pack. The contact plane of the edges of the cover and pack opening runs obliquely with respect to the bottom of the pack at an inclination from the back fold or connection line 16 toward the front opening edge 20.

The closed cover 14, with its front and side flaps, encloses a conventional glued-in insert 22 which projects from the pack opening, as is customary with such containers.

The contents of the container, illustrated as a pack block 24 with cigarettes which are conventionally paper-covered and wrapped in metal foil, extends out of the opening of insert 22, also sometimes referred to as a border, and projects into the hinged cover.

The section of insert 22 lying at the front of the pack has a stamped out or cutout recess 26 to hold an attached coin 28 or the like without allowing it to slide. In the embodiment which is shown, the recess includes a semicircular cutout portion protruding from the insert and an indented portion, forming a semicircular wall, adjacent the insert, the entire plane of the circular portion being inwardly offset from the front face of the insert so as to receive the coin. The insert in the particular embodiment shown has a relatively deep U-shaped recess. With a pack in which the insert 22 has a less deep cutout, a more closed recess can be provided to completely encircle coin 28. As will be recognized, for the attachment of two coins, two recesses can easily be provided, one adjacent the other.

The recesses 26 can be formed by an embossing process or a cutting and shaping machine, forming the recesses in the front section of the border insert 22, and the packages can then be presented in series to a packaging machine in accordance with a preferred embodiment of the coin attachment process. The advantage connected therewith is secure positioning and holding of the attached coins.

Figure 2:
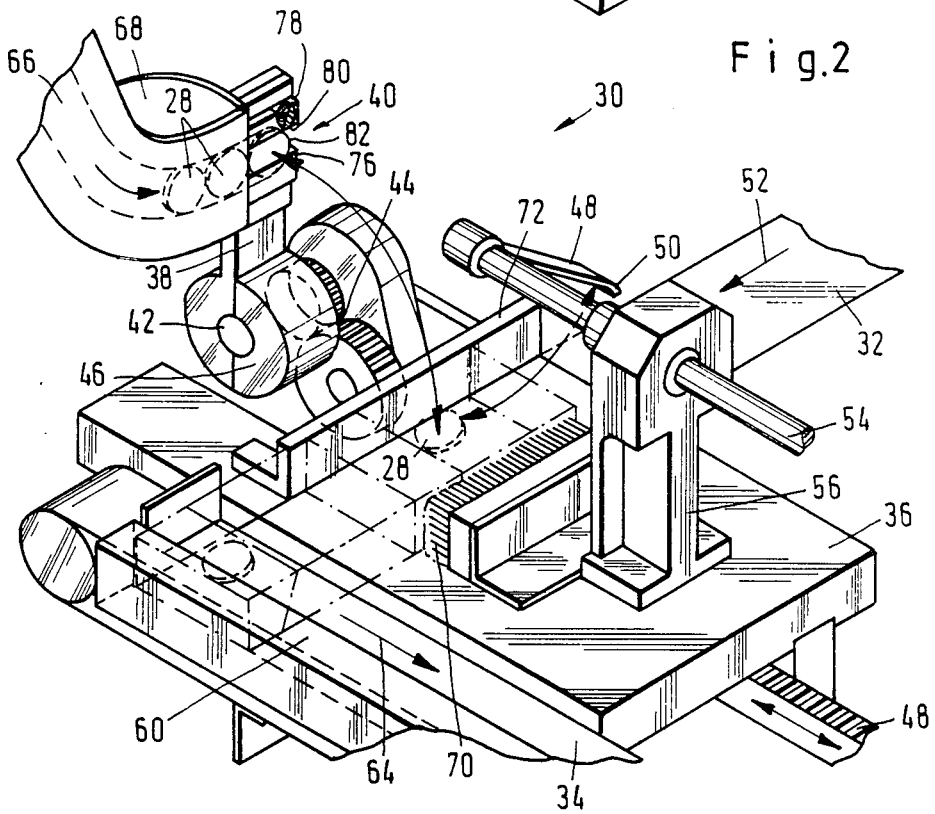
FIG. 2 is a perspective view of an apparatus for attaching tokens to a container in accordance with the invention, the apparatus being shown in a first work position.
Figure 3:
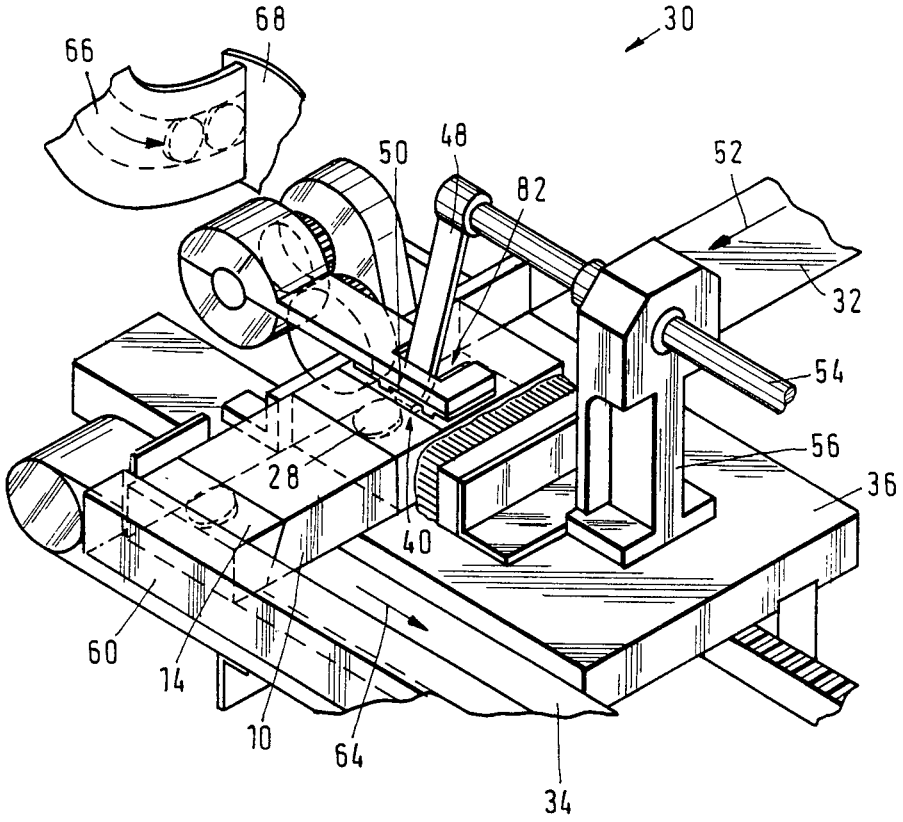
FIG. 3 is a similar perspective view of the apparatus of FIG. 2 with components thereof in a second work position.

Reference will now be made to FIGS. 2 and 3 which show one embodiment of a coin attachment device in accordance with the present invention, the machine being shown in a somewhat simplified and partially schematic form for clearer understanding.

The coin attachment device, indicated generally at 30, is placed in the path of a conveyor system 32,34 for handling cigarette packages, the system normally being of a type which would also include other conveyance devices.

Apparatus 30 includes a support plate 36 which lies in substantially the same plane as the upper surfaces of the conveyor system between conveyor belt segments 32 and 34 which can be, as shown in the illustrated example, at right angles to each other.

Device 30 has a delivery arm 38 which is pivotally mounted at one end to an axle 42 and, at the other end, has means defining a recess for receiving and holding a coin or other token 28. The arm 38 which is attached to axle 42 can pivot about an axis which is parallel to the direction of movement of conveyor belt segment 32, the axis preferably lying in substantially the same plane as the upper surface of the conveyor belt. A simplified gearing arrangement 44 is provided to control and adjust the activity of the recess 40 which will function as a portion of the token installation apparatus. The gearing meshes, in the embodiment shown, with the outer teeth of an eye bearing 46 of arm 38 and can be operated by means of a toothed rack 48 which is movable longitudinally and attached to a mechanical control apparatus of conventional type, not shown.

Device 30 also includes a pusher arm 48 at the end of which is mounted a pusher 50. The end of arm 48 is preferably curved downwardly, in the direction of the movement of belt 32 and packs 10 supported thereon, to form pusher 50.

A shaft 54, extending transversely with respect to conveyor belt segment 32 pivotally supports arm 48 with pusher 50 and is, in turn, rotatably supported, at a distance related to the distance of movement of recess 40 with respect to the packs 10 which are moving in the direction of arrow 52. The shaft 54 is supported in a bearing block 56 which rests on table 36. For the control of movement of pusher 50 between the positions shown in FIGS. 2 and 3, and also for the operation of device 40, gearing which is attached to the previously mentioned machine control engages shaft 54.

A limit stop 60 is provided along the side of conveyor belt segment 34 in order to stop and securely hold in position one of the packs moving along belt 32 for purposes of accomplishing the coin attachment process in a predetermined location. In the embodiment shown, in which the packs are moved in the direction of arrow 52 with the front faces thereof facing upwardly and with the top end of each pack entering the attachment station formed by device 30 as the belt moves, the stop 60 is formed by a rail extending across the end of pack 30 a distance equal to the length of a pack beyond the attachment station, the rail simultaneously forming a side guide for subsequent movement of packs 10 in the direction of arrow 64 along belt segment 34.

Thus, with this arrangement, a pack 10 which is located in the vicinity of feeder device 40 and pusher 50 of apparatus 30 engages during the attachment process on stop 60 while being supported by another pack which has left the attachment station of device 30 following coin attachment.

Other arrangements can also be provided for the control of the stop instead of the guide rail. With such different embodiments, such as a slidable or pivotable detent or holding element on plate 36, cooperation can be accomplished directly with the pack moved into the desired position for the attachment process.

An arrangement of device 30 of known structural type to feed coins 28 or the like includes a feed chute 66 arranged as shown in FIGS. 2 and 3 such that the coins contained therein lie in a sequence in a plane parallel with conveyor belt segment 32 and adjacent to the belt, the discharge end of the feed chute being in alignment with device 40 in the position shown in FIG. 2. As will be recognized, arm 38 and recess 40 can be moved between two positions, the arm being swingable between a receiving position in which the recess is adjacent the end of the chute for receiving a token and a delivery position in which the recess is adjacent the upper surface of the container and pressing downwardly against the container when the container is in the predetermined position defined by stop 60.

A blocking element 68 adjacent the discharge opening of the feed chute 66 either blocks or leaves open the chute 66 depending upon the work position of device 40. In the embodiment shown, blocking element 68 is an arcuate plate attached to or otherwise coupled to the device forming recess 40 such that when the delivery arm is out of the position shown in FIG. 2 the arcuate plate is pivoted directly in front of the discharge opening of chute 66. Plate 68 rests as shown in FIG. 2 with the open end of device 40 at the distal end of arm 38 adjacent the discharge opening of chute 66 from whence it extends in a rearward curve running transversely to conveyor belt segment 32. The curve radius and arc length of plate 68 corresponds to the movement path of arm 38 and device 40 as it swings from one position to the other so that the discharge end of chute 66 is blocked during the entire movement of device 40 out of its receiving position.

It would be possible in a different embodiment to form blocking element 68 as a stop member supported in front of the discharge end of the chute supported in that position by means of a leaf spring mounted on the back of the feed chute, the blocking element being movable by contact with the back of device 40 when the device moves into its receiving position, thereby opening the end of the chute.

Along opposite sides of belt segment 32 are side guides 70,72 to position the packs 10, the side guides being mounted on plate 36 parallel with the conveyor belt segment. One of these parallel side guides is elastic or resilient and can consist of a brush 70 which accommodates uneveness or nonuniformities in the packs and positions packs by breaking the moving packs as they move into the coin attachment process station.

With one advantageous simple embodiment of the invention, the installation device 40 on arm 38 consists essentially of two parallel guide rails 76,78 having openings turned toward each other, as generally illustrated in FIG. 2, with the transverse cross section of feed chute 66 in alignment with guide grooves therein to hold a token 28 which comes into it. A limit stop 80 present on the other end of device 40, lying at a distance from chute 66, can be arranged at the end of at least one of the rails 76,78 forming the guide groove.

Guide rails 76,78 lie on opposite sides of a cutout 82 which is formed in a wall of the arm 38, the cutout extending inwardly from the side of the wall which faces away from chute 66, where it forms an entry passage for pivot arm 48 of pusher 50.

The apparatus 30 works with a predetermined cadence in such a manner that packs 10, having been filled at a packaging station, are moved with the cover closed and with the cover end leading and the pack front face upwardly, in the direction of arrow 52 on conveyor belt segment 32 in attachment station 30 and are securely held at that location for the coin attachment process by stop 60 and side guides 70,72, positioning each pack in sequence in a predetermined position. Following the coin attachment process, the packages are moved further in transport direction 52 out of the attachment station and, finally, in the direction of arrow 64 onto conveyor belt segment 34, lying transversely to segment 32, and further onto a film wrapping station.

In the work position shown in FIG. 2 a coin 28 is fed out of feed chute 66 into recess 40. Recess 40 is then moved by swingable arm 38 transverse to conveyor belt segment 32 into the position adjacent the closure line or abutment line 18 of pack cover 14, pressing downwardly on the front of the pack 10 which is being held in the station as generally illustrated in FIG. 3. At this time, blocking element 66 is in its position of blocking the discharge end of chute 66.

As a result of the downward pressure being exerted in this work position on the front face of pack 10, which is largely cardboard, a slit-like opening is produced between the distal edge 20 of pack 10 and the front face of the pack, which is being pressed downwardly, creating a small clearance.

As soon as device 40 reaches this delivery position, pusher 50 is moved out of the position shown in FIG. 2 and pivot arm 48 is swung into the position shown in FIG. 3. Near the end of this movement, pusher 50 moves in a direction which is substantially parallel with direction 52 and enters the opening 82 formed in the back wall of arm 38 adjacent recess 40 and engages the edge of coin 28 contained therein.

As the movement of arm 48 and pusher 50 continues, the movement being essentially parallel with the front, upper face of the pack, coin 28 is shoved out of device 40, through the slit-like opening formed between the cover edge 18 and opening edge 20 under the front flap of cover 14 into the recess 26 illustrated in FIG. 1. Then, in sequence, arm 48 with pusher 50 is swung back into the position shown in FIG. 2, followed by the movement of arm 38 with device 40, returning to the position of FIG. 2. As soon as device 40 releases the pack, the front face thereof returns to its original position, closing the clearance formed between edges 18 and 20 and trapping the coin within the package. The package is then moved along to the film wrapping station and the next pack is moved into position for the same coin insertion.

A simple widening of device 30 is possible to permit the attachment or insertion of two coins. The widened device then has two parallel coin feed chutes 66 which are associated with two parallel installation devices 40 on arm 38 and can be blocked with a correspondingly widened blocking element 68. Parallel pushers 50 are suitably associated with both installation devices 40 and can be operated together, as are the installation devices.

The movements of the installation devices and pushers of attachment device 30 can also be controlled in the widened embodiment with the aid of mechanical control of a packaging machine corresponding to the work cadence which is being used.

The early results of experimental application of the invention show that the device according to the invention works satisfactorily with a customary work cadence for packing machines of, for example, 360 packs per minute.

While certain advantageous embodiments have been chosen to illustrate the invention it will be understood by those skilled in the art that various changes and modifications can be made therein without departing from the scope of the invention as defined in the appended claims.

What is claimed is:

1. A method for attachment of a coin-like token to a generally parallelepipedic container, such as a cigarette box, of the type formed from stiff material and having a hinged cover with a front flap which forms a transverse abutment line with the front face of the container in its closed position, the container including an insert portion lying adjacent the front flap of the cover, the insert portion surface being surrounded by the cover in the closed position, comprising the steps of:

forming in the insert portion a recess of the general size and shape of the token to be inserted, securely holding the container with its front face up and the cover closed, placing a token on the front face of the container adjacent the abutment line, pressing downwardly on the front face of the container to form a slit-like opening between the front face and the lower edge of the cover flap, pushing the token under the flap through the opening, and releasing the downward pressure.

2. A method according to claim 1 and further comprising conveying the container with its front face up and with the cover leading to an attachment station at which the container is held securely for token attachment.

3. An apparatus for attaching a coin-like token to a generally parallelepipedic container, such as a cigarette box, of the type formed from stiff material and having a hinged cover with a front flap which forms a transverse abutment line with the front face of the container in its closed position, comprising conveyor means for delivering a container to a predetermined location at an attachment station;

stop menas for holding a container at said location;

a feed chute near said attachment station for delivering tokens to the end thereof;

a pivotally mounted delivery arm having means defining a recess at one end for holding a token, said arm being swingable between a receiving position in which said recess is adjacent the end of said chute for receiving a token and a delivery position in which said recess is pressing against the front face of a container in said predetermined location, thereby forming an opening between said front face and the cover flap;

means for blocking the end of said chute when said delivery arm is not in said receiving position; and a pusher arm movable into said recess to push a token therefrom into said opening and under said cover flap.

4. An apparatus according to claim 3 wherein said pusher arm includes a pivot arm, means for pivotally mounting said pivot arm for rotation about an axis perpendicular to the pivot axis of said delivery arm, and means defining a pusher member at the distal end of said pusher arm, said means for mounting said pivot arm including means for adjusting the location of said pivot arm axis.

5. An apparatus according to claim 4 wherein said pusher member comprises the bent distal end of said pivot arm, bent in the direction of conveyance of said container.

6. An apparatus according to claim 3 wherein said recess on said delivery arm includes means defining a slot having an open end facing said feed chute in said receiving position and a limit stop at the end away from from said feed chute.

7. An apparatus according to claim 3 wherein said means defining said recess includes a side wall which lies above said token in said delivery position and means in said wall defining a slot to permit passage therein of said pusher arm.

8. An apparatus according to claim 7 wherein said pivot axis of said delivery arm lies substantially in the plane containing the horizontal front face of said container in said predetermined location and is generally parallel to and laterally offset from said conveyor means, and wherein said pivot axis for said pivot arm lies above and in transverse to said conveyor means.

9. An apparatus according to claim 4 wherein said recess on said delivery arm includes means defining a slot having an open end facing said feed chute in said receiving position and a limit stop at the end away from from said feed chute.

10. An apparatus according to claim 4 wherein said means defining said recess includes a side wall which lies above said token in said delivery position and means in said wall defining a slot to permit passage therein of said pusher arm.

11. An apparatus according to claim 8 wherein said recess on said delivery arm includes means defining a slot having an open end facing said feed chute in said receiving position and a limit stop at the end away from from said feed chute.

12. An apparatus according to claim 5 wherein said recess on said delivery arm includes means defining a slot having an open end facing said feed chute in said receiving position and a limit stop at the end away from from said feed chute.

13. An apparatus according to claim 5 wherein said means defining said recess includes a side wall which lies above said token in said delivery position and means in said wall defining a slot to permit passage therein of said pusher arm.

14. An apparatus according to claim 11 wherein said means defining said recess includes a side wall which lies above said token in said delivery position and means in said wall defining a slot to permit passage therein of said pusher arm.

15. An apparatus according to claim 8 wherein said means defining said recess includes a side wall which lies above said token in said delivery position and means in said wall defining a slot to permit passage therein of said pusher arm.

16. An apparatus according to claim 14 wherein said recess on said delivery arm further includes inwardly facing coplanar rails parallel with said side wall, the inner edges of said rails being spaced apart.

* * * * *